United States Patent [19]

Del Corso et al.

[11] Patent Number: 4,693,863

[45] Date of Patent: Sep. 15, 1987

[54] PROCESS AND APPARATUS TO SIMULTANEOUSLY CONSOLIDATE AND REDUCE METAL POWDERS

[75] Inventors: Gregory J. Del Corso, Sinking Spring; Robert E. Carnes; David Esposito, both of Reading, all of Pa.

[73] Assignee: Carpenter Technology Corporation, Reading, Pa.

[21] Appl. No.: 849,809

[22] Filed: Apr. 9, 1986

[51] Int. Cl.[4] ..... B22F 3/14; C22C 29/02; C22C 29/16

[52] U.S. Cl. ..... 419/13; 419/14; 419/19; 419/28; 419/42; 419/45; 419/48; 266/83; 266/108; 266/255; 75/236; 75/244

[58] Field of Search ..... 419/13, 14, 19, 28, 419/35, 39, 42, 45, 48, 51; 266/83, 108, 115, 252, 255, 257, 272; 75/236, 244

[56] References Cited

U.S. PATENT DOCUMENTS

| | | | |
|---|---|---|---|
| Re. 28,301 | 1/1975 | Havel . | |
| 3,150,444 | 9/1964 | Reen . | |
| 3,244,506 | 4/1966 | Reen . | |
| 3,357,826 | 12/1967 | Honaker et al. | 419/19 |
| 3,359,098 | 12/1967 | Teaford | 419/27 |
| 3,419,935 | 1/1969 | Pfeiler et al. . | |
| 3,543,345 | 12/1970 | Boyer . | |
| 3,578,443 | 5/1971 | Grant et al. | 419/19 |
| 3,599,281 | 8/1971 | Boyer . | |
| 3,622,313 | 11/1971 | Havel . | |
| 3,704,508 | 12/1972 | Di Giambattista . | |
| 3,741,733 | 6/1973 | Kieffer | 75/238 |
| 3,746,518 | 7/1973 | Holtz, Jr. . | |
| 3,814,598 | 6/1974 | Gabriel et al. | 419/19 |
| 3,834,004 | 9/1974 | Ayers . | |
| 3,893,852 | 7/1975 | Bergman et al. . | |
| 3,954,458 | 5/1976 | Roberts . | |
| 3,992,200 | 11/1976 | Chandhok | 419/45 |
| 4,104,061 | 8/1978 | Roberts . | |
| 4,227,927 | 10/1980 | Black et al. . | |
| 4,268,708 | 5/1981 | Smith, Jr. et al. . | |
| 4,469,514 | 9/1984 | Holtz, Jr. . | |
| 4,582,681 | 4/1986 | Asari et al. | 419/49 |
| 4,591,482 | 5/1986 | Nyce . | |
| 4,615,735 | 10/1986 | Ping . | |

FOREIGN PATENT DOCUMENTS 781083 8/1957 United Kingdom .

OTHER PUBLICATIONS

L. H. Mott, "Progress Report on Hot Forging Pre-Alloyed Metal Powders", 10/52.

*Primary Examiner*—John F. Terapane
*Assistant Examiner*—Eric Jorgensen
*Attorney, Agent, or Firm*—Edgar N. Jay; Vincent T. Pace

[57] ABSTRACT

A powder metallurgy consolidation process and apparatus for carrying out said process produces integral metal bodies by heating metal powder of a predetermined composition to a temperature sufficient to cause solid state interparticle bonding, while simultaneously maintaining a reactive fluid in contact with the metal powder. The metal powder is compacted to a density greater than 90% of the full theoretical density of the composition after the reactive fluid has been removed. The reactive fluid is selected to modify the powder particle surface chemistry in order to improve bondability and to obtain other properties as desired. Metal bodies which have been consolidated by the process are sufficiently dense to be mechanically hot worked and exhibit exceptionally low retained gas content.

39 Claims, 1 Drawing Figure

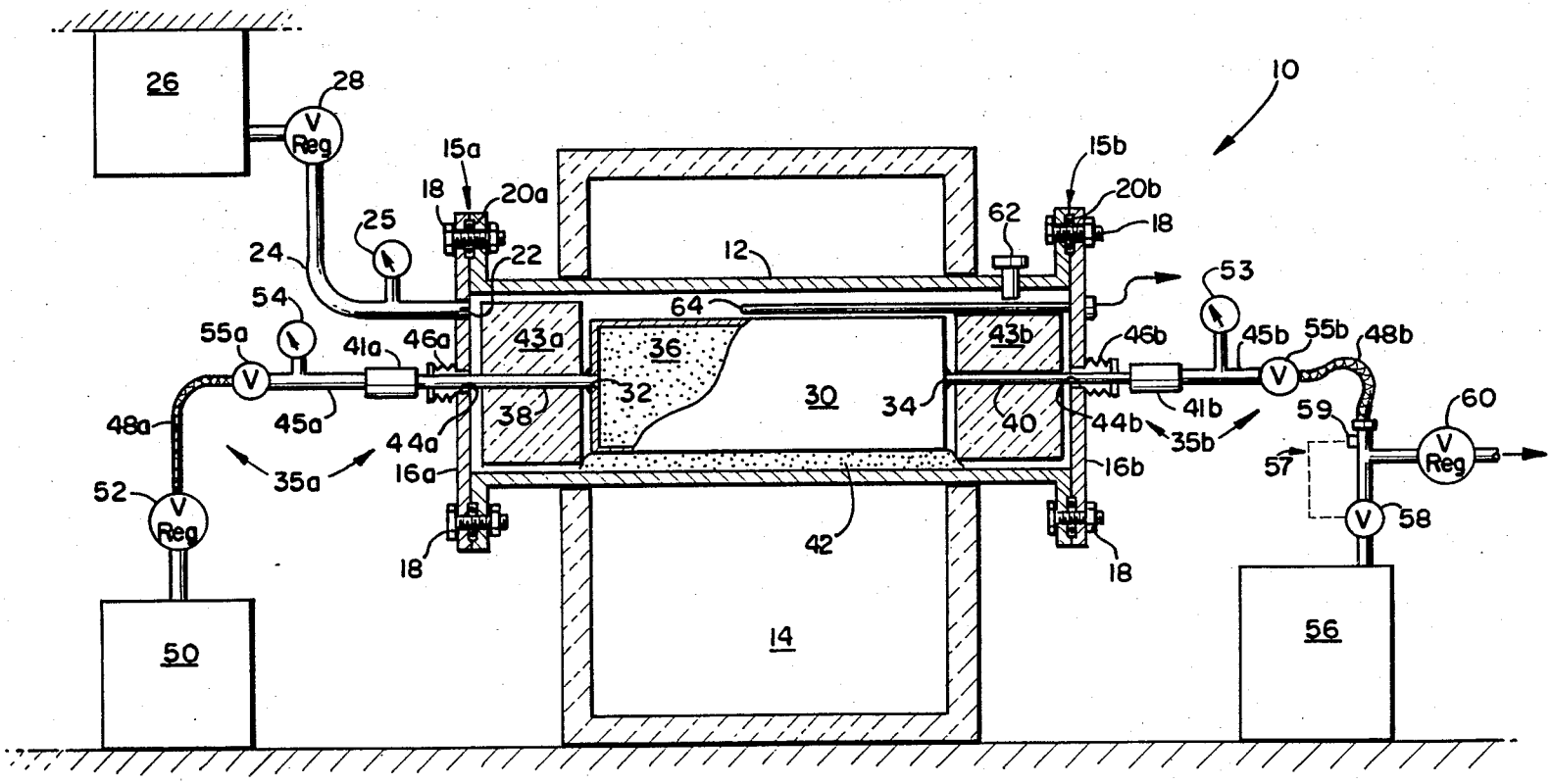
10
12
14
15a
15b
16a
16b
18
20a
20b
22
24
25
26
28
30
32
34
35a
35b
36
38
40
41a
41b
42
43a
43b
44a
44b
45a
45b
46a
46b
48a
48b
50
52
53
54
55a
55b
56
57
58
59
60
62
64
Reg

PROCESS AND APPARATUS TO SIMULTANEOUSLY CONSOLIDATE AND REDUCE METAL POWDERS

BACKGROUND OF THE INVENTION

This invention relates generally to production of consolidated bodies from metal powders and more particularly to a process and apparatus for simultaneously compacting and surface treating metal powder to form a metallic body which is sufficiently dense for subsequent mechanical hot working.

Techniques for producing consolidated bodies, including billets, bars, etc., from elemental and prealloyed metal powders, such as atomized high speed tool alloys, have been known for some time. Processes and apparatus for carrying out the same which have been known for producing consolidated metal powder bodies include charging a container with the metal powder, heating the charged container to a preselected temperature at which at least some sintering will occur, and then consolidating the metal powder to eliminate, or at least minimize, porosity. Some processes include chemical or thermal pretreatment of the metal powder to enhance its sinterability by removing oxides on the surfaces of the metal powder particles. The consolidation step is accomplished by means of either mechanical or isostatic compaction. Although most of the known processes, and their corresponding apparatus, for producing consolidated metal powder bodies have provided satisfactory products, each has certain technical and/or economic drawbacks.

A published article, L. Mott, *Progress Report on Hot Forging Prealloyed Metal Powders,* Precision Metal Molding, Oct. 1952, relates to a process of forming metal objects from prealloyed metal powders, primarily tool steels. The process includes the steps of compacting the prealloyed powder in a shaped container, sintering the compacted powder in a controlled atmosphere to prevent decarburization, followed by hot coining. Mott discloses that the compacted powder may be sintered in an atmosphere of hydrogen or hydrogen bearing compounds. Mott describes the production of a fully dense metal body having a fine metallurgical microstructure. According to Mott, because of the way they are made, each powder particle prior to consolidation is in the ideal state for providing a uniform carbide distribution in that each is a supersaturated solid solution. Those particles when consolidated at a temperature below the formation temperature of the massive carbide can then be heat treated to precipitate carbon as small substantially spheroidal carbides, uniformly distributed throughout the consolidated body, the size of the precipitated carbide particles being a function of the precipitating temperature.

Comstock et al, British Patent No. 781,083, Aug. 14, 1957, relates to a method which includes compacting a prealloyed powder into a shaped form at room temperature, heating the compacted powder in a reducing atmosphere to a preselected temperature, and then hot coining to final shape and density.

Reen, U.S. Pat. No. 3,150,444, Sept. 29, 1964, relates to a method of producing an alloy steel body from prealloyed metal powder. The method includes the steps of forming a fine particle alloy steel powder, green compacting the powder such as by rolling, sintering the green compact in the presence of a carbonaceous reducing atmosphere, and then mechanically working the sintered body until it achieves a denseness of at least 90% of that attained by the same alloy in the normally cast and wrought form. Reen , U.S. Pat. No. 3,150,444 indicates that the carbonaceous reducing atmosphere may consist of at least 0.1% by volume hydrocarbon gas and the balance essentially a nonhydrocarbon reducing gas such as hydrogen. According to Reen, U.S. Pat. No. 3,150,444, high speed tool steel bodies produced following the process exhibit an even distribution of small carbides which had long been known to be desirable in such tool steel members.

Reen, U.S. Pat. No. 3,244,506, Apr. 5, 1966, relates to a method of producing cutting tool alloy bodies from a prealloyed metal powder. The method includes forming a fine metal powder, deoxidizing the metal powder by exposing it to hydrogen. gas, packing the powder into a mild steel tube, and evacuating and sealing the powder-filled tube. The sealed tube is heated to about 2150 F. and then extruded through a conventional extrusion die. Reen, U.S. Pat. No. 3,244,506 states that extrusion pressures used in the examples range from 2100–2700 psi. The resulting metal alloy body is stated to have a denseness substantially equivalent to the alloy in its cast state.

Pfeiler et al., U.S. Pat. No. 3,419,935, Jan. 7, 1969, and Havel, U.S. Pat. No. Re. 28,301, Jan. 14, 1975, a reissue of U.S. Pat. No. 3,622,313, Nov. 23, 1971, relate to hot isostatic pressing (HIP), another well known process, by which encapsulated metal powder is heated and compacted by a fluid, usually a gas, under a pressure of at least 500 psi while it is at a selected consolidation temperature. HIP units are, however, very expensive to construct and install because they must withstand high pressure.

DiGiambattista, U.S. Pat. No. 3,704,508, Dec. 5, 1972, relates to consolidation by atmospheric pressure in which the metal powder is first treated with a sintering activation agent and then sealed in an evacuated glass container or mold. The container is then heated in a standard air atmosphere furnace to sinter the metal powder. The sintering activation agent is intended to accelerate sintering by chemically combining with metal oxides on the powder particle surfaces to form compounds, such as borates which do not inhibit bonding. Black et al., U.S. Pat. No. 4,227,927, Oct. 14, 1980, also relates to consolidation by atmospheric pressure. Consolidation by atmospheric pressure is typically performed at temperatures close to the solidus of the particular alloy since such temperatures tend to promote densification. However, when a glass container is used, the glass container softens and shrinks as consolidation occurs during sintering. Therefore glass containers must be supported so the mass will not lose shape during sintering. Graphite or clay-graphite crucibles, like the glass containers they are used to support, are readily broken when being handled or moved, thereby adding to the cost of the process.

Holtz, Jr., U.S. Pat. No. 3,746,518, July 17, 1973, and U.S. Pat. No. 4,469,514, Sept. 4, 1984, relate to a method for producing iron, chromium, nickel, and/or cobalt based metal powder bodies by a process which includes forming a prealloyed metal powder of the desired composition in which carbides are said to be submicroscopic and consolidating by hot working to form a body said to be substantially fully dense and containing uniformly distributed carbides less than 3 microns in major dimension. The only discernible difference between the Holtz, Jr. process and the prior Mott and Comstock processes appears to reside in Holtz, Jr.'s assertions regarding carbide size and distribution.

Ayers, U.S. Pat. No. 3,834,004, Sept. 10, 1974, relates to a method of producing billets from powdered tool steel. The Ayers process includes a thermal treatment of heating encapsulated powder to a temperature in the range of 1700 to 2250 F., followed by mechanically hot working the heated powder. The intermediate product produced by the Ayers thermal treatment step is less than 90% of theoretical density. Such high porosity makes it necessary to mechanically hot work the intermediate product in such a way that excessive interpowder-particle strains do not occur, otherwise cracking of the metal powder body and/or tearing of the encapsulating canister may result. Consequently, consolidation must be carried out as a series of relatively light mechanical hot working and reheating steps which tend to prolong the process.

Bergman et al., U.S. Pat. No. 3,893,852, July 8, 1975 relates to the introduction of a non-reactive gas into a canister containing the metal powder charge in order to increase the heat transfer to the metal powder as it is being heated in a HIP process. The gas is used during a thermal pretreatment step in which the encapsulated metal powder is heated in a conventional furnace prior to sealing of the container and insertion into a pressurized furnace or HIP unit.

Smith, Jr. et al., U.S. Pat. No. 4,268,708, May 19, 1981, relates to a process and apparatus in which the metal powder is subjected to liquid phase sintering in a vessel to provide a workpiece substantially free of porosity. The workpiece is then subjected to an isostatic gas pressure of approximately 15,000 psi in the same vessel for a preselected time period in order to further consolidate it. The combination of liquid phase sintering and hot isostatic pressing functions in one vessel however, renders it more complex and time consuming than conventional HIP units.

Cold mechanical or isostatic pressing are techniques utilizing high pressure to compact a metal powder into a predetermined shape at ambient temperature. Although the process is carried out at room temperature, extremely high pressures, for example, at least about 15,000 psi for isostatic pressing and at least about 30,000 psi for mechanical pressing, are required to obtain the desired compaction. The resulting consolidated powder body is significantly less than fully dense, however, being densified to only 60–80% of theoretical density. Such low denseness is not sufficient to permit mechanical hot working and further consolidation as by sintering is required in order to achieve the necessary denseness in the metal powder body.

The foregoing processes have left much to be desired. The processes which have hitherto used mechanical cold or hot consolidation have required unduly repetitious handling and working of the bodies. The processes which rely on cold or hot isostatic pressing require relatively high pressure vessels which are expensive and inherently dangerous to operate. Additionally, cold isostatically consolidated shapes require an additional step of sintering before they can be mechanically hot worked.

SUMMARY OF THE INVENTION

Accordingly, a principal object of this invention is to provide a process and apparatus for consolidating metal powders in a container by which the metallurgical bonding among the powder particles and between the powder particles and the container wall is substantially improved over known processes.

Another object of this invention is to provide a relatively simple process and apparatus for forming metallurgical bodies which are consolidated to a denseness sufficient for subsequent mechanical hot working.

Another object of this invention is to reduce the residual gas content of consolidated powder metallurgy bodies to substantially lower levels than provided by prior powder metallurgical methods.

A further object of this invention is to provide a process and apparatus for closely controlling the consolidation of metal powders in order to obtain preselected metallurgical conditions at the surfaces of the metal powder particles.

A still further object of this invention is to provide a process and apparatus for consolidating metal powders at superatmospheric pressures but at substantially less than conventional hot or cold isostatic compaction pressures.

Yet another object of this invention is to provide a process and apparatus for substantially accomplishing the foregoing objects which is relatively simple and requires relatively low capital cost to carry out.

A still further object of this invention is to provide a consolidated metallurgical body having sufficient denseness for subsequent mechanical hot working to substantially full denseness in a single mechanical hot working step.

The above and other objects are realized in the present invention which provides a novel process and apparatus for consolidating an encapsulated metal powder by which a reactive fluid, preferably a gas, is brought into contact with the powder particles so as to modify the surface thereof. While being exposed to the reactive fluid, the powder is simultaneously heated to a predetermined, elevated consolidation temperature and compacted to a density at least equal to that required for subsequent mechanical hot working to substantially full denseness. In accordance with one preferred embodiment the reactive fluid deoxidizes the surfaces of the powder particles. Other embodiments include utilizing fluids which cause oxiding or nitriding of the powder particles. In a further embodiment a gaseous substance is introduced while maintaining the interior of the powder container at less than atmospheric pressure. In a still further embodiment the process is carried out in two stages in which the encapsulated powder is subjected to an initial compaction pressure during heating and conditioning of the powder, and then to a second higher compaction pressure after reaching the elevated consolidation temperature.

A preferred apparatus for carrying out the process includes a heating chamber the interior of which can be maintained at a desired temperature. The heating chamber is constructed to withstand relatively low pressures and thereby also serves as a pressure vessel. The container in which the metal powder is enclosed, has tubulations extending from both its ends, through sealable openings in the heating chamber for connection to a reactive fluid supply and a vacuum system whereby the interior of the powder container may be evacuated and the reactive fluid applied to the powder. A pressurized source of fluid is connected to the interior of the heating chamber/pressure vessel to provide the desired compaction force.

The present process and apparatus produce integral metallurgical bodies from metal powders which exhibit substantially reduced oxygen and nitrogen contents over other known processes. Tool alloy bodies formed by the present process and apparatus exhibit a microstructure including nonuniformly dispersed small to medium size carbide particles a substantial portion of which are greater than 3 micrometers in major dimension. The metallurgical bodies produced by the present process are less than fully dense but are sufficiently dense to be mechanically hot worked to substantially full theoretical density.

BRIEF DESCRIPTION OF THE DRAWING

Further objects as well as advantages of the present invention will be apparent from the following detailed description of the invention and the accompanying drawing which is a diagrammatic view partially in elevation and partially in section of a preferred apparatus for carrying out the process of the present invention.

DETAILED DESCRIPTION OF THE INVENTION

The Process

The process and apparatus of the present invention are used advantageously in the production of consolidated metallurgical bodies prepared from a wide variety of compositions including one or more elemental powders, prealloyed powders, with or without nonmetallic particles, and mixtures thereof so as to provide desired properties in an article ultimately to be formed from the consolidated body. The powder can be prepared in any conventional manner, for example by gas or liquid atomization. The particle size distribution is not critical, but the particle size or distribution of particle sizes is preferred which permits a tap density of at least 65% of theoretical density. Tap density is defined as the net fill weight of the unconsolidated powder divided by the volume of the receptacle into which it has been loaded and which has been tapped or vibrated while being filled. The process according to the present invention consolidates a powder mass by simultaneous application of heat, pressure, and a reactive fluid, preferably a gaseous substance, to the metal powder. The powder is preferably encapsulated in a container while undergoing the consolidation process. The container is preferably a thin-walled metal canister, for example a mild steel or stainless steel. It is also contemplated that the container can be made of any suitable material, including glass, that is sufficiently flexible as it is heated to the consolidating temperature to collapse around the powder mass, without rupturing, as the latter consolidates during the process.

When the container is filled, steps are taken to ensure that the container is substantially completely filled with powder before the consolidating process is begun. To that end, the container should be tapped or vibrated to provide a high enough fill density to ensure good contact between the container walls and the powder mass. A pre-consolidation density greater than 60%, preferably at least 65% of theoretical density is generally sufficient for most metal powders. Such tight packing of the powder helps to reduce both distortion of the body during consolidation and residual interconnected porosity at the powder/container interface. In the case of metal powders which have very low tap densities, e.g. less than 60% of theoretical density it is preferred to precompact the powder as by cold isostatic pressing. For metal powders having chemistries which are sensitive to oxidation, a gas purge to eliminate air contamination of the powder is preferred after the container is filled but before the consolidation process is started.

The process according to the present invention is carried out by simultaneously heating the powder-filled container while maintaining a controlled atmosphere of a reactive fluid in contact with the metal powder, and compacting the metal powder within the container. Compaction is preferably carried out isostatically. Although the compaction pressure may not be completely isostatic in the purest sense of that term due to tubulations connected in the ends of the container, the tubulation cross sections are small enough not to adversely affect the compaction of the encapsulated powder, and compaction is carried out essentially isostatically. Steps can be taken to prevent the metal powder from escaping into the tubulations during compaction, such as by inserting fine mesh screens over the inlet and outlet ports of the container. The present process is capable of producing consolidated metallurgical bodies having preselected properties. Moreover, the quality and quantity of the desired end properties can be controlled during the process since it is a dynamic process which can be monitored and adjusted, particularly with respect to the atmosphere inside the metal container.

During the process cycle the metal powder is generally heated to an elevated temperature sufficient to cause solid state sintering of the powder particles. In most cases this temperature is preferably at least 20° F. (about 11° C.) below the incipient melting temperature of the particular metal. Liquid phase sintering is undesirable for alloys with dispersed hard phases, such as tool alloys. Liquid phase sintering occurs at temperatures which tend to promote nonuniform growth of massive hard phase particles upon resolidification. Enlarged hard phase particles such as carbides, are often undesirable in such alloys. For example, enlarged carbide particles although beneficial to wear resistance, cause degradation of grindability. Carbide particles in excess of 8–10 micrometers in major dimension adversely affect heat treating of the alloy body and can cause chipping of tools made therefrom.

Solid state sintering is preferred because powder particle bonding occurs due to interparticle diffusion without observable melting of the powder particle surfaces. As is well known, the temperature range in which solid state sintering occurs is determined, at least in part, by the composition of the alloy. In general then, since it is desired not to melt the powder, the maximum usable process temperature is one sufficiently below the incipient melting temperature of the particular metal to ensure against local melting.

The reactive fluid used in the process is selected based on the type of metal powder being consolidated and the properties desired to be imparted to the metal powder. A gaseous substance is preferred and is selected to modify the surface chemistry of the powder particles in a desired manner. For example, in one embodiment a deoxidizing or reducing gas, such as hydrogen or a hydrogen-bearing gas, is used to remove oxides from the surfaces of the powder particles, thereby enhancing the sinterability of the powder. Removal of surface oxides improves grain growth because such oxides can otherwise cause prior powder particle boundaries which inhibit grain growth. Removal of oxides from the powder particle surfaces and from the container wall also promotes diffusion bonding among the particles and between the powder and the container wall. This is particularly advantageous in the preparation of clad bodies. Substantially improved bonding between the cladding and the clad material results in a more reliable product because the likelihood of decladding is significantly reduced.

In other compositions it is desirable to promote particle surface-oxide formation. For example, in an embodiment of the present process for the formation of dispersion strengthened materials, oxygen, an oxygen bearing gas such as carbon dioxide, or hydrogen gas having a high dew point is used with a prealloyed powder including one or more oxide-forming elements, such as aluminum. The introduction of an oxidizing atmosphere promotes particle surface oxide formation. The consolidated and subsequently hot-worked dispersion strengthened alloy is capable of withstanding exposure to very high temperatures without appreciable softening.

In still other compositions it is desirable to promote formation of nitrides in the alloyed material. Nitriding is accomplished by introducing a nitrogenous atmosphere, such as dissociated ammonia, to the encapsulated, prealloyed powder containing one or more nitride forming elements. Likewise, the alloy powder may be carburized, or carbonitrided. Carburizing is accomplished through the introduction of a suitable carburizing gas such as a hydrocarbon gas (e.g. methane, ethane, butane, etc.). Carbonitriding of the metal powder may also be carried out by introduction of a hydrocarbon gas in combination with dissociated ammonia. Moreover, carburizing gases may be used simply to prevent the decarburization of the powder metal being consolidated. Other metallurgical treating gases such as endothermic and exothermic gases are used in other embodiments of the process depending on the desired treatment of the metal powder.

In practicing the process according to this invention it is preferred that the interior of the powder-filled container be maintained at subatmospheric pressure, that is to say, a vacuum, during the entire process cycle. The term subatmospheric pressure as used herein is defined to mean a pressure less than one atmosphere (approx. 760 mm Hg). Maintaining subatmospheric pressure in the container during the present process provides a number of advantages. For example, subatmospheric pressure promotes flow of the reactive gas through the powder. Maintaining subatmospheric pressure also helps to control the quantity of reactive gas used as well as to control competing thermodynamic reactions. It assists in the deoxidation of the powder particle surfaces by removing oxygen from the atmosphere inside the container. It further helps to minimize or substantially eliminate the reactive fluid from the powder mass as it consolidates to form an integral body. Additionally, maintaining the interior of the container connected to a vacuum pump results in the removal of powder particle contaminants, particulate contaminants in the powder, as well as other substances such as air, nitrogen, and water vapor from the container thereby improving the cleanness of the powder which results in improved powder bonding. Although the level of vacuum will depend on such conditions as the fill density of the metal powder, the pressure of the reactive fluid, and the integrity of the container, it is preferred that as high a vacuum as practicable be used.

The gaseous substance is introduced into the container at a positive pressure relative to the interior of the container. The flow rate of the gaseous substance is controlled so that the gas will flow freely through and permeate the powder mass. Permeation is necessary to provide as complete contact with the powder particles as possible. The actual flow rate utilized depends on such diverse parameters as the chemistry of the powder, the powder particle size, the geometry of the container, and the fill density. Those skilled in the art of powder metallurgy can readily determine and apply the proper rate of flow to provide a chemically correct proportion of the gaseous substance to accomplish the desired reaction. Suffice it to say that gas flow rates in the range of 0.3–0.6 standard cubic feet per hour (scfh) have been found to give good results for containers holding about 8–50 lbs. (3.63–22.68 kg) of metal powder.

Compaction of the powder mass is preferably achieved by applying a relatively inert gas to the exterior of the container in such a way that the entire external surface of the container, including its end walls, is pressed against the metal powder to consolidate the same. Such contact between the container wall and the powder not only facilitates consolidation of the powder, but also promotes diffusion bonding between the powder and the container wall. An inert gas is used in order to minimize chemical reactions between the gas and the container and muffle walls. Nitrogen is preferred as the pressurizing gas. However, other inert gases such as argon can also be used. Compressed air can also be used but it is not preferred because of its oxygen content.

The quantity of pressure utilized depends to a certain extent on the material being consolidated and the container design. The compaction pressure must be sufficient to effect a force sufficient to densify the metal powder at the selected consolidation temperature. Pressures of at least about 115–165 psia have been found to give good results in carrying out the process on small samples. The upper limit on compaction pressure is determined with respect to the design strength of the pressure vessel at the consolidation temperature. Pressures in excess of 500 psia are undesirable because the complexity and cost of the required pressure vessels increases to an unacceptable level.

Oxygen and nitrogen are metal embrittling agents in that they can combine with other elements to form oxides and nitrides, respectively, which cause localized increases in intergranular stresses as the material undergoes external loading. Intergranular oxide or nitride formation can also cause cracking of a metallurgical body during hot working. Hydrogen can also be an embrittling agent when retained in some alloys. Accordingly, a further embodiment of the present invention is provided in which the process is carried out in two stages to reduce retained gases more effectively. During the first stage the encapsulated powder is subjected to an initial compaction pressure of about 25–40 psia as the powder is being heated to the consolidation temperature while under a controlled atmosphere of the reactive fluid. In the second stage, the reactive fluid is discontinued after the consolidation temperature is achieved, the interior of the container is maintained under vacuum to remove residual gases, and the compaction pressure is increased to a pressure in the range of 115–500 psia to complete compaction of the metal powder. The two stage embodiment of the present process is more effective in removing residual gases such as oxygen, nitrogen, and hydrogen and is preferred when reduction of such gases is important. Gas levels of less than 50 parts per million (ppm) oxygen, less than 50 ppm nitrogen, and less than 3 ppm hydrogen have been attained by using this two stage process.

APPARATUS FOR CARRYING OUT THE PROCESS

Referring now to the drawing there is shown a preferred apparatus 10 for carrying out the process according to this invention which includes muffle 12 which is mounted in a heating furnace 14. The term "muffle" as used herein is defined to include an enclosure, such as an oven, situated in a furnace for protecting the article being heated from the flame and combustion by-products of the furnace. Muffle 12 is preferably in the shape of a hollow cylinder and fabricated from a high temperature alloy such as "Pyromet 600", a registered trademark of Carpenter Technology Corp. for a UNS NO6600 high temperature alloy. Furnace 14 is of conventional design such as a gas-fired heating furnace. The muffle 12 is preferably mounted in a horizontal orientation in furnace 14, as shown in the drawing. Since consolidation by the present process and apparatus can be carried out with the encapsulated powder in a horizontal position, it is practical to place more than one muffle in a furnace, thereby facilitating large scale production.

Muffle 12 also serves as a pressure vessel and to that end has removable means for sealing the ends thereof indicated generally at 15*a* and 15*b*. Sealing means 15*a* and 15*b*, respectively, include closures such as end plates 16*a* and 16*b* which may be constructed of the same material as muffle 12. Endplates 16*a*, 16*b* are connected to respective ends of muffle 12 by fastening means such as bolts 18 to form a gastight seal with gaskets 20*a*, 20*b*, of suitable sealing material disposed between the end plates 16*a*, 16*b* and muffle 12. End plate 16*a* is equipped with an inlet port 22 through which the pressurizing gas is admitted to the interior of muffle 12. A pressurizing gas supply conduit 24 connects inlet port 22 to a pressurizing gas source 26. A regulating valve 28 is connected in conduit 24 at source 26 for controlling the pressurizing gas flow. A pressure gauge 25 is connected in conduit 24 adjacent to muffle 12 for indicating the pressure therein during the process.

A metal canister 30 filled with metal powder 36 to the desired fill density is sealed off except for an inlet port 32 in one end and an outlet port 34 in the other end. Conduit means 35*a* and 35*b* connect the canister 30 to a reactive gas source 50 and a vacuum system 56, respectively. Conduit means 35*a* includes a gas inlet tubulation 38 connected to the gas inlet port 32. A coupling 41*a* joins tubulation 38 to a tee connector 45*a* to which a vacuum/pressure gauge 54 and a shut-off valve 55*a* are also connected. Expansion means such as flexible tubing 48*a* interconnects shut-off valve 55*a* and a control valve 52 which is associated with the reactive gas source 50 for controlling the flow of gas therefrom.

Similarly, conduit means 35*b* includes a vacuum tubulation 40 connected to the vacuum outlet port 34 of canister 30. Coupling 41*b* joins tubulation 40 to a tee connector 45*b* having a vacuum gauge 53 and a shut-off valve 55*b* connected thereto. Flexible tubing 48*b* interconnects shut-off valve 55*b* and vacuum system 56. Flexible tubings 48*a* and 48*b* permit the conduit means 35*a* and 35*b* respectively, to move with the canister 30 during consolidation. The inlet tubulation 38 and vacuum tubulation 40 are preferably constructed of rigid metal tubing and are connected to canister 30 by welding.

The powder filled canister 30 is placed inside the muffle 12 and supported with its tubulations 38 and 40 aligned to pass through openings 44*a* and 44*b* respectively, formed in end plates 16*a* and 16*b* respectively. Insulation plugs 43*a*, 43*b* formed of suitable material are disposed at each end of canister 30 to minimize heat loss at the ends of muffle 12. A suitable slip plane medium consisting of for example, powdered or bubble alumina 42 is disposed between the canister 30 and the muffle 12. The slip plane medium reduces friction between the canister 30 and the muffle 12 to assure uniform contraction of the canister 30 during consolidation of the metal powder 36. The gas inlet tubulation 38 is sealed to end plate 16*a* by a gastight, flexible seal 46*a* and vacuum tubulation 40 is similarly sealed to end plate 16*b* by gastight, flexible seal 46*b*. Flexible seals 46*a* and 46*b* are provided to prevent the pressurizing gas from leaking from muffle 12 to the outside environment while permitting gas inlet tubulation 38 and vacuum tubulation 40 to move relative to the end plates 16*a*, 16*b*, respectively, when the ends of the canister 30 move during consolidation of the metal powder 36.

The vacuum system 56 is of conventional construction the details of which form no part of the present invention and need not be described here. Suffice it to say that in the apparatus used to carry out the following examples of the present invention, vacuum system 56 was designed to reduce the pressure in canister 30 to below 0.5 mm Hg if desired. The system includes a valve 58 linked to a pressure sensing switch 59 as indicated diagrammatically at 57 so that valve 58 is closed when the pressure in conduit means 35*b* reaches a predetermined value. Excess pressure is vented through a relief valve 60 calibrated to open at a preselected pressure level.

A pressure relief valve 62 is mounted on muffle 12 in a location suitable for detecting and preventing overpressurization of the muffle 12. One or more thermocouples 64 are mounted inside muffle 12 so that the temperature of the canister 30 and powder 36 can be measured and monitored.

The consolidation process according to this invention is preferably carried out using apparatus 10 as follows. The powder filled canister 30 is placed inside the muffle 12 which has been heated to the desired consolidation temperature by the furnace 14. The open ends of muffle 12 are closed off and sealed with end plates 16*a*, 16*b* and sealing gaskets 20*a*, 20*b*. The gas supply tubulation 38, which passes through opening 44*a* and flexible seal 46*a* is connected through to the supply vessel 50. Likewise, vacuum tubulation 40 which passes through opening 44*b* and flexible seal 46*b* is connected through to vacuum system 56.

Valve 55*a* is closed and valves 55*b* and 58 are opened. The interior of canister 30 is pumped down by the vacuum system 56. As the canister 30 is pumped down control valve 28 is opened and an inert, pressurizing gas such as nitrogen is introduced into the muffle 12 until the desired pressure is obtained therein.

Canister 30 is pumped down to a pressure preferably on the order of 0.5 mm Hg or less, as measured at gauge 54. When the desired level of vacuum has been reached, valve 55*a* is opened and the reactive gas is thereby introduced into the interior of canister 30. The gas is introduced at the preselected pressure, controlled by regulating valve 52, for all or a part of the consolidation process. The process is continued for a sufficient period of time to permit consolidation of the powder mass. The consolidated body is now in condition to be mechanically hot worked similar to the way conventionally cast ingots are hot worked to provide millform wrought products. For some compositions a density in the range of 90–94% of theoretical density is sufficient. The powder mass is, however, generally consolidated to greater than 94%, preferably at least 96%, of theoretical density up to the maximum attainable which under proper conditions may be 98% or more of theoretical full density.

It is desirable that the interior of canister 30 be protected from exposure to air in order to prevent oxidation of the metal body. To assure this, the canister 30 should be sealed before it is removed from muffle 12 after completion of the process. Sealing of the canister 30 can be accomplished by crimping inlet tubulation 38 and vacuum tubulation 40 before canister 30 is removed from the muffle 12.

As previously discussed, the process may also be carried out in two stages. During the first stage the muffle pressure, that is, the compaction pressure, is preferably kept in the range of 25–40 psia. This pressure range is sufficient to keep the container in contact with the powder mass as it consolidates while being subjected to the controlled atmosphere of reactive gas and as it is heated to the consolidation temperature.

In the second stage, after the powder mass reaches the consolidation temperature, the reactive gas is shut off and the muffle pressure is increased to 115–500 psia. The canister 30 is maintained under vacuum and the process is continued at temperature until the powder mass is consolidated to an integral body having the desired denseness.

The following examples are illustrative of the present invention. The examples were carried out using an apparatus which differs insignificantly from the preferred apparatus just described in that the muffle had a single end closure through which the tubulations were brought. The actual process used in the examples also varied insignificantly from the preferred mode in that the pump down of the powder filled canister and introduction of the reactive gas thereto were started before inserting the canister into the muffle. Moreover, as will be described below, the canister was purged with dry nitrogen gas before the reactive gas was introduced. None of these variations are considered to be material to the process and apparatus of the present invention.

EXAMPLE 1

A canister formed of A.I.S.I. 1010 mild steel measuring 10 in (about 25.4 cm) long, having an outside diameter of 4 in (about 10.2 cm), and a wall thickness of 0.125 in (about 0.32 cm) was filled in air to a tap density of 71.6% of full theoretical density with 22.73 lbs (about 10.31 kg) of metal powder having a particle size of −100 mesh (U.S.S.). The metal powder had a composition in weight percent as shown in Table 1.

TABLE 1

| | w/o | |
|---|---|---|
| Carbon | 1.53 | |
| Manganese | .31 | |
| Silicon | .28 | |
| Phosphorus | .010 | |
| Sulfur | .072 | |
| Chromium | 4.74 | |
| Nickel | .26 | |

TABLE 1-continued

| | w/o | |
|---|---|---|
| Molybdenum | .24 | |
| Copper | .05 | |
| Cobalt | 4.93 | |
| Vanadium | 4.62 | |
| Nitrogen | .048 | (about 480 ppm) |
| Oxygen | .047 | (about 470 ppm) |
| Tungsten | 12.31 | |

The balance was iron plus inconsequential amounts of other elements found in such alloys.

The powder-filled canister, hereinafter "the canister", was connected to an instrumented vacuum system and to instrumented hydrogen and nitrogen gas supplies. The canister was then pumped down to 0.21 mm Hg as indicated by vacuum gauge 53 and purged while under vacuum for 15 hours with nitrogen gas having a dew point of −76 F. (−60 C.).

Hydrogen gas having a dew point of −80 F. (about −62.2 C.) was then introduced into the interior of the canister and maintained at a flow rate of 0.3 standard cubic feet per hour (scfh). After 0.5 hours and while still under the hydrogen atmosphere and vacuum the canister was charged into a muffle which had been preheated to about 2175 F. (about 1191 C.) in a furnace. The pressure at the vacuum tubulation was about 0.99 mm Hg just prior to charging.

The muffle was closed, sealed, and pressurized to 10 psig with nitrogen gas having a dew point of −76 F. (−60 C.). The canister was heated to about 2175 F. (about 1191 C.), reaching that temperature about 2.5 hours after charging. The hydrogen gas flow was discontinued about 0.5 hours after the canister reached temperature.

The canister remained connected to the vacuum system to remove residual gas. About 1.0 hours after the hydrogen gas flow was discontinued the pressure in the muffle was increased to 150 psig. The canister was maintained under this pressure and at 2175 F. (about 1191 C.) for about 2.5 hours. At the end of that time period the heating furnace was shut down and the muffle was depressurized to five psig. The canister, while still under vacuum, was allowed to cool to 1400 F. (760 C.) inside the muffle. The muffle was depressurized to atmospheric pressure and the canister was then removed from the muffle and the tubulations crimped and severed while the canister was still under vacuum.

The as-processed body had a whole part density of 0.295 lbs/in$^3$ (about 8.16 g/cc) determined by averaging two readings of a water displacement test of the whole consolidated body. This density value is 99.6% of the full theoretical density of the starting alloy. The as-processed body had a composition in weight percent as shown in Table 2.

TABLE 2

| | w/o | |
|---|---|---|
| Carbon | 1.50 | |
| Manganese | .32 | |
| Silicon | .33 | |
| Phosphorus | .010 | |
| Sulfur | .067 | |
| Chromium | 4.88 | |
| Nickel | .09 | |
| Molybdenum | .15 | |
| Copper | — | |
| Cobalt | 4.94 | |
| Vanadium | 4.94 | |
| Nitrogen | .033 | (about 330 ppm) |

TABLE 2-continued

| | w/o | |
|---|---|---|
| Oxygen | .0033 | (about 33 ppm) |
| Hydrogen | .00012 | (about 1.2 ppm) |
| Tungsten | 12.46 | |

EXAMPLE 2

A canister formed of A.I.S.I. 304 stainless steel 10 in (25.4 cm) long having an outside diameter of 6 in (about 15.2 cm) and a wall thickness of 0.125 in (about 0.32 cm) was filled in air to a tap density of 72.0% of full theoretical density with 49.22 lbs. (22.33 kg) of metal powder having a particle size of −40 mesh (U.S.S.). The metal powder had a composition in weight percent as shown in Table 3.

TABLE 3

| | w/o | |
|---|---|---|
| Carbon | .041 | |
| Manganese | 1.81 | |
| Silicon | .58 | |
| Phosphorus | .021 | |
| Sulfur | .006 | |
| Chromium | 18.50 | |
| Nickel | 13.70 | |
| Molybdenum | .19 | |
| Copper | .13 | |
| Nitrogen | .020 | (about 200 ppm) |
| Oxygen | .030 | (about 300 ppm) |
| Boron | 2.23 | |

The balance was iron plus inconsequential amounts of other elements found in such alloys.

The powder-filled canister was then processed as described in connection with Example 1, except as follows. The canister was pumped down to 0.25 mm Hg as indicated by vacuum gauge 53 before the nitrogen purge. The hydrogen gas was maintained at a flow rate of 0.6 scfh. Just prior to charging the canister into the preheated muffle, the pressure at the gas inlet tubulation was about 50.7 mm Hg and the pressure at the vacuum tubulation was about 2.0 mm Hg.

After charging, the muffle was pressurized to 100 psig with argon gas having a dew point of −76 F. (−60 C.). The canister was heated to about 2096 F. (about 1147 C.), reaching that temperature about 4 hours after charging.

The canister remained connected to the vacuum system for about 0.5 hours after the hydrogen gas was discontinued. The muffle pressure was then increased to and maintained at 150 psig and the temperature maintained at 2096 F. (about 1147 C.) for 5.0 hours.

Two 75 gram sample cubes measuring $\frac{3}{4}$ in on a side were cut from the as-processed body after it had cooled. Sample A was taken from the edge of the compacted body and Sample B, from the center. The densities of the samples as shown below in Table 4 were determined by water immersion testing after the samples were impregnated with oil.

TABLE 4

| | Density |
|---|---|
| Sample A | .273 lbs/in$^3$ (about 7.56 g/cc) |
| Sample B | .274 lbs/in$^3$ (about 7.59 g/cc) |

These values are respectively 97.9% and 98.3% of the full theoretical density of the alloy. The as-processed body had a composition in weight percent as shown in Table 5.

TABLE 5

| | w/o | |
|---|---|---|
| Carbon | .041 | |
| Manganese | 1.80 | |
| Silicon | .56 | |
| Phosphorus | .022 | |
| Sulfur | .004 | |
| Chromium | 18.50 | |
| Nickel | 13.60 | |
| Molybdenum | .16 | |
| Copper | .14 | |
| Nitrogen | .020 | (about 200 ppm) |
| Oxygen | .016 | (about 160 ppm) |
| Hydrogen | .00024 | (about 2.4 ppm) |
| Boron | 2.22 | |

The balance was iron plus inconsequential amounts of other elements found in such alloys.

EXAMPLE 3

About 22.7 lbs. (about 10.3 kg) of INCO 123 high purity nickel powder having a particle size of −325 mesh was cold isostatically pressed at 30 ksi in a urethane bag density of about 68.0% of full theoretical density. The nickel powder had a composition in weight percent as shown in Table 6.

TABLE 6

| | w/o |
|---|---|
| Carbon | .061 |
| Sulfur | .001 Max. |
| Oxygen | .09 (about 900 ppm) |
| Iron | .01 Max. |

The balance was nickel plus inconsequential amounts of other elements found in such metal powders. The as-pressed powder compact was about 9.375 in (about 23.8 cm) long and had an average diameter of 3.72 in (about 9.45 cm). The powder compact was placed in a canister formed cf A.I.S.I. 304 stainless steel 10 in (25.4 cm) long having an outside diameter of 4 in (about 10.2 cm) and a wall thickness of 0.125 in (about 0.32 cm). The thus encapsulated powder was then processed as described in Example 1, except as follows.

The canister was pumped down to 0.25 mm Hg as indicated by vacuum gauge 53 before the nitrogen purge. The nitrogen purge was maintained for 16 hours. Just prior to charging the canister into the muffle the pressure at the vacuum tubulation was about 1.1 mm Hg and the pressure at the inlet tubulation was off scale at less than 25 mm Hg.

After charging, the muffle was pressurized to 100 psig with argon gas as in Example 2. Just after the muffle pressure was increased to 100 psig the pressure at the gas inlet tubulation increased to about 469 mm Hg and the pressure at the vacuum tubulation decreased to 1.0 mm Hg. One half hour later the pressure at the gas inlet tubulation had increased to a positive pressure of 8 psig while the pressure at the vacuum tubulation decreased further to 0.52 mm Hg. The hydrogen flow rate meanwhile, decreased to about 0.1 scfh. Thirty-five minutes thereafter, the pressure at the vacuum tubulation had decreased to 0.09 mm Hg and the hydrogen flow rate had dropped to about 0.05 scfh. The inlet pressure was then manually increased to 15 psig in an attempt to increase the flow of hydrogen through the powder. The vacuum tubulation pressure was then observed to decrease to 0.04 mm Hg and the gas flow rate became unmeasurable at less than 0.05 scfh. The canister reached the temperature of about 2100 F. (1149 C.) about 2.75 hours after charging.

A further attempt was made to increase the flow of hydrogen through the powder by reducing the muffle pressure to 25 psig for about 3.2 hours. The muffle pressure was thereafter increased to 150 psig. About 0.25 hours later the hydrogen gas flow was shut off and the vacuum system was reconnected such that the canister could be evacuated through both tubulations.

The muffle was maintained at 150 psig and at about 2100 F. (1149 C.) for about 4.5 hours while the canister was evacuated through both tubulations to remove residual gas. The muffle was depressurized to about 30 psig and the furnace shut down. The canister was cooled to near room temperature in the muffle. The canister was then removed from the muffle and the tubulations were crimped and cut.

A 75 g sample cube was cut from the as-processed body after it had cooled. The sample was taken from a mid-radius region of the body between the surface and the center. The density was determined to be 0.314 lbs/in$^3$ (8.68 g/cc) which is about 97.53% of the full theoretical density.

The as-processed body had a composition in weight percent as shown in Table 7.

TABLE 7

| | w/o |
|---|---|
| Carbon | 0.026 |
| Manganese | <0.001 |
| Silicon | <0.002 |
| Sulfur | 0.007 |
| Chromium | <0.002 |
| Copper | <0.001 |
| Cobalt | <0.001 |
| Titanium | <0.001 |
| Nitrogen | <0.001 |
| Oxygen | <0.002 |
| Iron | 0.005 |
| Magnesium | <0.001 |

The balance was nickel plus inconseqential amounts of other elements found in such metal products.

It is contemplated that the present process and apparatus for carrying out the same, either the embodiments thereof described herein or others, which will be readily apparent to those skilled in the art, can be used in producing a wide variety of powder metallurgy products from prealloyed metal powders as well as elemental metal powders. In general it is contemplated that the present process and apparatus will provide a significant improvement in the manufacture of powder metallurgy products by improving the metallurgical bonding among powder particles and between the powder particles and the encapsulating container. Moreover, consolidated powder metallurgy bodies formed according to the present process have substantially lower residual gas content than those produced by conventional methods. Consolidated powder bodies produced by this process are sufficiently dense for subsequent mechanical hot working.

Apparatus for carrying out the present process is relatively simple and is relatively inexpensive to install and operate when compared to conventional equipment.

While various embodiments of the present process and of the products prepared thereby have been described, as well as of the apparatus for carrying out the process, further variations thereof within the scope of the claims will be apparent to those skilled in the art. The terms and expressions which have been employed are used as terms of description and not of limitation. There is no intention in the use of such terms and expressions of excluding any equivalents of the features shown and described or portions thereof. It is recognized that various modifications are possible within the scope of the invention claimed.

What is claimed is:

1. In a process for making an integral, mechanically hot workable metal body from powder, the steps of providing a porous charge of metal powder particles having a predetermined composition and volume;

forcing a reactive fluid to flow into an inlet portion of the charge while confining the reactive fluid to the volume of the charge, such that it substantially completely permeates the pores of said charge and flows out of an outlet portion thereof;

heating said charge to a consolidation temperature at which solid state sintering of the metal powder particles occurs but below the incipient melting point of the metal powder while said reactive fluid is in contact with said metal powder and thereby modifying the chemistry of at least the surfaces of the metal powder particles in a predetermined manner;

applying an external force to said charge as it is heated, so as to partially compact it while leaving it porous to the reactive fluid flowing therethrough said external force being distinct from any force caused by the flow of the reactive fluid through said charge thereafter removing said reactive fluid from said metal powder charge; and then further compacting the metal powder to a density greater than about 90% of the full theoretical density of said predetermined composition.

2. A process as recited in claim 1 in which said charge of metal powder is in a container that is deformable at said consolidation temperature.

3. A process as recited in claim 2 in which said container is formed of metal.

4. A process as recited in claim 2 in which the metal powder is compacted isostatically.

5. A process as recited in claim 4 in which the metal powder is isostatically compacted by an inert fluid at a pressure selected to effect a force sufficient to densify said metal powder at the consolidation temperature.

6. A process as recited in claim 5 in which the compaction pressure is in the range of 25–500 psia.

7. A process as recited in claim 5 in which the compaction pressure is in the range of 115–165 psia.

8. A process as recited in claim 2 in which said metal powder has a fill density in said container greater than about 60% of theoretical density.

9. A process as recited in claim 1 in which at least the outlet portion of said charge is maintained at substantially subatmospheric pressure while said reactive fluid is forced through said metal powder.

10. A process as recited in claim 9 in which said charge is maintained at a subatmospheric pressure less than 0.5 mm Hg.

11. A process as recited in claim 9 in which the reactive fluid is supplied at a flow rate sufficient to provide a chemically correct proportion of reactive fluid to substantially complete the modification of the powder particle chemistry.

12. A process as recited in claim 6 in which the reactive fluid is supplied at a rate of flow in the range of 0.3–0.6 standard cubic feet per hour.

13. An integral, mechanically hot workable metal body formed by the process of claim 9.

14. A process as recited in claim 1 in which the reactive fluid is a gaseous substance.

15. A process as recited in claim 14 in which the gaseous substance is selected from the group consisting of deoxidizing gases, nitriding gases, oxidizing gases, carburizing gases, and carbonitriding gases.

16. A process as recited in claim 14 wherein the metal powder is a prealloyed composition including carbon and one or more carbide forming elements.

17. A process as recited in claim 16 in which the reactive fluid consists essentially of deoxidizing gas.

18. A process as recited in claim 17 in which the deoxidizing gas is selected from the group consisting of hydrogen, dissociated ammonia, carbon monoxide hydrocarbon gases endothermic gas, and exothermic gas.

19. An integral metal body formed by the process of claim 17.

20. An integral body as recited in claim 19 which has a density greater than 94% of the full theoretical density of the predetermined composition.

21. An integral metal body as recited in claim 20 which has a density greater than 98% of the full theoretical density of said predetermined composition.

22. An integral metal body as recited in claim 19 which has a non-uniform distribution of discrete and agglomerated carbide particles having a size range predominately greater than 3 micrometers in major dimension.

23. An integral metal body as recited in claim 22 which is substantially free of oxygen.

24. An integral metal body as recited in claim 23 having up to about 50 parts per million retained oxygen.

25. An integral body as recited in claim 22 which is substantially free of hydrogen.

26. An integral metal body as recited in claim 25 having up to about 3 parts per million retained hydrogen.

27. An integral metal body formed by the process of claim 17 having up to about 70 parts per million retained nitrogen.

28. A process as recited in claim 14 in which the metal powder is a prealloyed composition containing one or more nitride forming elements and the reactive fluid consists essentially of a nitrogenous gas, whereby nitriding of the metal powder is effected simultaneously with consolidation of said metal powder.

29. A process as recited in claim 14 in which the metal powder is a prealloyed composition containing one or more oxide forming elements and the reactive fluid consists essentially of an oxidizing gas, whereby said integral metal body is oxide dispersion strengthened simultaneously with consolidation of said metal powder to form the same.

30. A process as recited in claim 1 in which said reactive fluid is removed from said metal powder charge while said charge is at consolidation temperature.

31. An integral, mechanically hot workable metal body formed by the process of claim 1 said integral body being substantially free of reactive fluids and having a density greater than 90% of the full theoretical density of said predetermined composition.

32. A process as recited in claim 1 in which said elevated consolidation temperature is at least about 20° F. (11° C.) below the incipient melting point of said metal powder.

33. Apparatus for producing an integral, mechanically hot workable metal body from powder, comprising a muffle for receiving a porous charge of metal powder of a predetermined composition and volume;

means for sealing said muffle gastight with said metal powder charge therein;

first conduit means for providing communication between an inlet portion of said metal powder charge and a source of reactive fluid;

second conduit means for providing communication between an outlet portion of said metal powder charge and a vacuum system;

said first and second conduit means communicating with each other through said metal powder charge so that the reactive fluid is forced to flow through said metal powder charge, such that it substantially completely permeates the pores of said charge;

means for confining the reactive fluid flow to the volume of the metal powder;

means for heating said metal powder charge in said muffle to a preselected consolidating temperature while the reactive fluid is flowing through the metal powder charge; and means for compacting said metal powder while heating it and while maintaining the flow of reactive fluid therethrough.

34. Apparatus as recited in claim 33 wherein said confining means comprises a deformable container encapsulating the metal powder.

35. Apparatus as recited in claim 34 further comprising means for reducing friction between the metal powder charge and said muffle.

36. Apparatus as recited in claim 33 in which said heating means comprises a furnace.

37. Apparatus as recited in claim 33 in which said sealing means comprises:

an end closure having one or more sealable openings;

a sealing gasket disposed between said end closure and said muffle, and fastening means for tightly closing said end closure against said gasket and said muffle, whereby a gastight seal is formed.

38. Apparatus as recited in claim 33 in which said compacting means comprises means for isostatically compacting said metal powder.

39. Apparatus as recited in claim 33 wherein said first and second conduit means include expansion means for permitting elongation of said first and second conduit means as the metal powder charge is compacted.

* * * * *

UNITED STATES PATENT AND TRADEMARK OFFICE

CERTIFICATE OF CORRECTION

PATENT NO. : 4,693,863

DATED : September 15, 1987

INVENTOR(S) : Del Corso, et al.

It is certified that error appears in the above-identified patent and that said Letters Patent is hereby corrected as shown below:

Column 14, line 25, after "urethane bag" add --to a--;
Column 14, line 41, "cf" should be --of--.

Signed and Sealed this

Twenty-sixth Day of April, 1988

*Attest:*

DONALD J. QUIGG

*Attesting Officer*

*Commissioner of Patents and Trademarks*